US008657565B2

(12) United States Patent
Coleman et al.

(10) Patent No.: US 8,657,565 B2
(45) Date of Patent: Feb. 25, 2014

(54) PUMP WITH INTEGRATED DEFLATION PORT

(75) Inventors: Brian Coleman, Hawthorn Woods, IL (US); Vincent Wen, Taipei (TW)

(73) Assignee: The Coleman Company, Inc., Wichita, KS (US)

( * ) Notice: Subject to any disclaimer, the term of this patent is extended or adjusted under 35 U.S.C. 154(b) by 864 days.

(21) Appl. No.: 12/765,653

(22) Filed: Apr. 22, 2010

(65) Prior Publication Data

US 2011/0259453 A1 Oct. 27, 2011

(51) Int. Cl.
*F04D 1/00* (2006.01)

(52) U.S. Cl.
USPC ..... 415/121.2; 5/713; 137/565.12; 415/213.1

(58) Field of Classification Search
USPC ..... 5/713; 137/223, 565.11, 565.12; 415/121.2, 206, 211.2, 213.1
See application file for complete search history.

(56) References Cited

U.S. PATENT DOCUMENTS

| | | | | |
|---|---|---|---|---|
| 4,977,633 | A | 12/1990 | Chaffee | |
| 5,267,363 | A | 12/1993 | Chaffee | |
| 5,367,726 | A | 11/1994 | Chaffee | |
| 6,237,621 | B1 | 5/2001 | Chaffee | |
| 6,237,653 | B1 | 5/2001 | Chaffee | |
| 6,508,264 | B2 | 1/2003 | Chaffee | |
| 6,543,073 | B2 * | 4/2003 | Wu | 5/713 |
| 6,598,626 | B2 | 7/2003 | Chaffee | |
| 6,648,004 | B2 * | 11/2003 | Lau | 137/223 |
| 6,755,208 | B2 | 6/2004 | Chaffee | |
| 6,793,469 | B2 * | 9/2004 | Chung | 417/411 |
| 6,964,134 | B2 | 11/2005 | Chaffee | |
| 6,986,360 | B2 | 1/2006 | Chaffee | |
| 7,000,276 | B2 | 2/2006 | Chaffee | |
| 7,008,155 | B2 * | 3/2006 | Smith et al. | 410/119 |
| 7,025,576 | B2 | 4/2006 | Chaffee | |
| 7,039,972 | B2 | 5/2006 | Chaffee | |
| 7,040,347 | B2 * | 5/2006 | Wang | 137/625.22 |
| 7,313,837 | B2 * | 1/2008 | Wang | 5/706 |
| 7,328,472 | B2 | 2/2008 | Chaffee | |
| 7,346,950 | B2 * | 3/2008 | Chung | 5/706 |
| 7,380,301 | B2 * | 6/2008 | Chung | 5/713 |
| 7,412,738 | B2 | 8/2008 | Chaffee | |
| 7,424,760 | B2 | 9/2008 | Chaffee | |

(Continued)

FOREIGN PATENT DOCUMENTS

| | | |
|---|---|---|
| EP | 1707821 | 10/2006 |
| WO | 0187121 | 11/2001 |

OTHER PUBLICATIONS

International Search Report PCT/US2011/033261, Dec. 9, 2011.

*Primary Examiner* — Edward Look
*Assistant Examiner* — Christopher R Legendre
(74) *Attorney, Agent, or Firm* — Kilpatrick Townsend & Stockton LLP

(57) ABSTRACT

A pump for an inflatable device includes a housing that defines a blower chamber configured to be inserted into the inflatable device. The blower chamber includes an exhaust port configured to communicate air out of the pump. The housing also defines a deflation port, which is adjacent to the blower chamber, and an attachment portion configured to make a substantially airtight seal with the surface of the inflatable device. The pump also includes a removably attachable cover configured to substantially cover the blower chamber. The cover defines an opening through which the deflation port extends, and at least one vent through which air is communicated into the pump.

20 Claims, 5 Drawing Sheets

(56) References Cited

U.S. PATENT DOCUMENTS

| | | | | |
|---|---|---|---|---|
| 7,475,440 | B2 | 1/2009 | Chaffee | |
| 7,571,500 | B2 * | 8/2009 | Wu | 5/173 |
| 7,644,724 | B2 | 1/2010 | Chaffee | |
| 7,938,138 | B2 | 5/2011 | Chaffee | |
| 8,016,572 | B2 | 9/2011 | Chaffee | |
| 8,162,009 | B2 | 4/2012 | Chaffee | |
| 2006/0073012 | A1 | 4/2006 | Song et al. | |
| 2006/0085918 | A1 * | 4/2006 | Metzger | 5/713 |
| 2006/0204361 | A1 * | 9/2006 | Xie | 415/182.1 |
| 2007/0104592 | A1 * | 5/2007 | Wu | 417/321 |
| 2007/0227594 | A1 * | 10/2007 | Chaffee | 137/224 |
| 2009/0170421 | A1 * | 7/2009 | Adrian et al. | 454/349 |
| 2009/0300846 | A1 | 12/2009 | Chaffee | |
| 2010/0014993 | A1 * | 1/2010 | Wang et al. | 417/315 |
| 2010/0247337 | A1 * | 9/2010 | Tsai | 417/239 |
| 2010/0247356 | A1 * | 9/2010 | Tsai | 417/423.14 |
| 2011/0259453 | A1 * | 10/2011 | Coleman et al. | 137/565.17 |

* cited by examiner

PUMP WITH INTEGRATED DEFLATION PORT

BACKGROUND

I. Field

The present invention relates generally to pumps. More specifically, the present invention relates to a pump with an integrated deflation valve.

II. Description of Related Art

Inflatable mattresses have become popular due to their utility as an extra bed needed around the house or on camping trips. An advantage of such inflatable mattresses is that they are portable and easily stored. A pump is typically required to fill these mattresses quickly and efficiently. For example, a battery-operated or corded pump may be provided with the mattress and adapted to fill the mattress with air. In some cases, the pump is integrated into the air mattress. In this case, the perimeter of the pump is glued or welded to the mattress. To facilitate deflation of the mattress, a separate deflation port is also glued or welded to the mattress.

However, the increase in the number of items glued and/or welded to the mattress increases the manufacturing costs of the mattress and increases the chances of a leak developing.

SUMMARY

An embodiment of a pump for an inflatable device includes a housing that defines a blower chamber configured to be inserted into the inflatable device. The blower chamber includes an exhaust port configured to communicate air out of the pump. The housing also defines a deflation port, which is adjacent to the blower chamber, and an attachment portion configured to make a substantially airtight seal with the surface of the inflatable device. The pump also includes a removably attachable cover configured to substantially cover the blower chamber. The cover defines an opening through which the deflation port extends, and at least one vent through which air is communicated into the pump.

BRIEF DESCRIPTION OF THE DRAWINGS

The accompanying drawings are included to provide a further understanding of the invention and are incorporated in and constitute a part of this specification. The detailed description and illustrated embodiments of the invention serve to explain the principles of the invention.

DETAILED DESCRIPTION

Figure 1A:
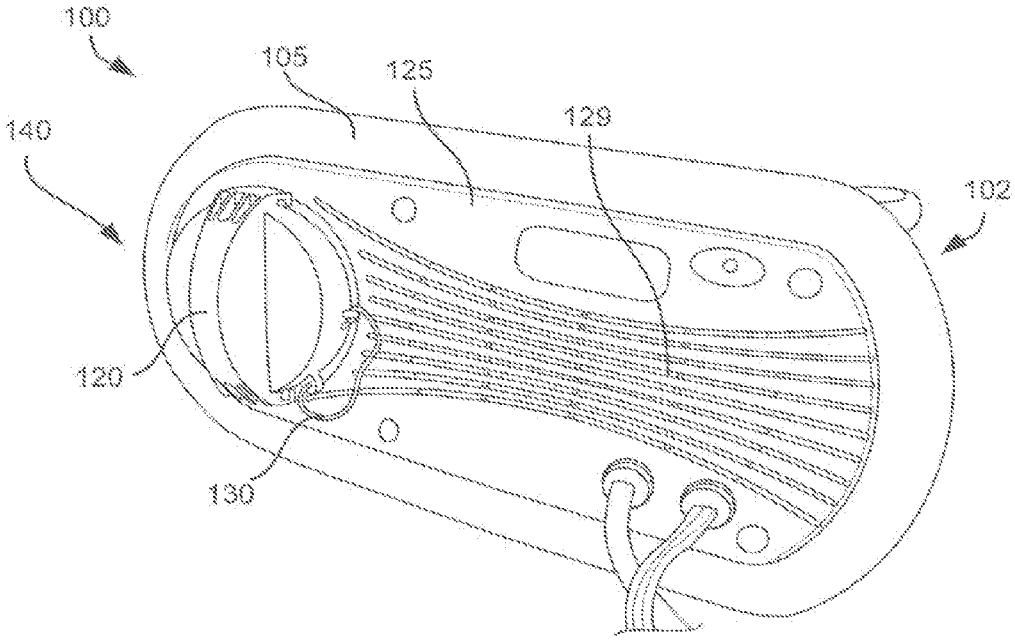
FIGS. 1A and 1B illustrate a front and rear perspective views, respectively, of a pump for an inflatable device.
Figure 1B:
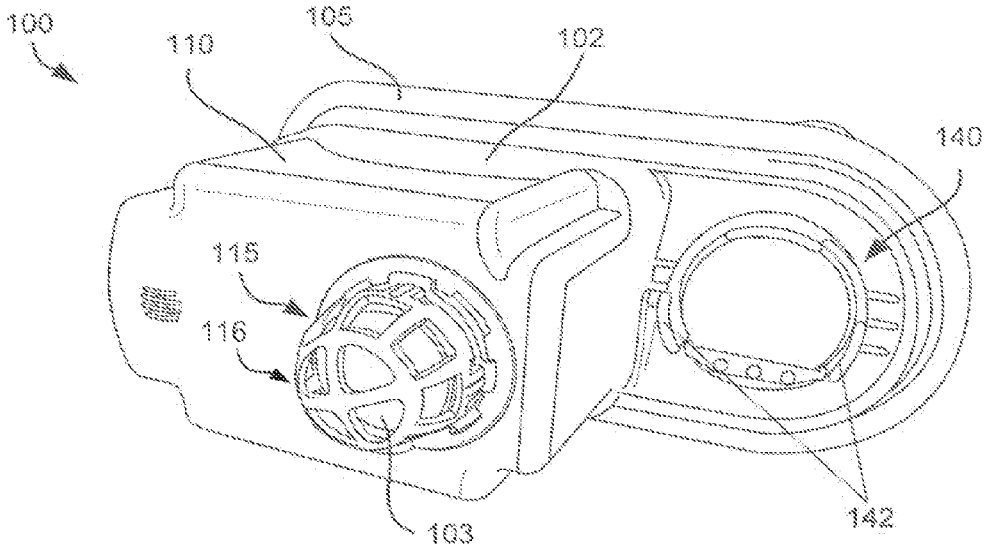

FIGS. 1A and 1B illustrate front and rear perspective views, respectively, of a pump 100 for an inflatable device 500 (FIG. 5), such as an inflatable air mattress or other inflatable support device. The pump 100 includes a housing 102 that defines a blower chamber 110, a deflation port 140, and an inflatable device attachment portion 105, hereinafter referred to as the attachment portion 105. The pump 100 also includes a cover 125.

The attachment portion 105 is configured to form a substantially airtight seal with the surface of the inflatable device 500. The attachment portion 105 may be glued or welded to the surface of the inflatable device 500 or may be fastened to the inflatable device 500 in a different way that produces a substantially airtight seal between the pump 100 and the inflatable device 500.

Figure 5:
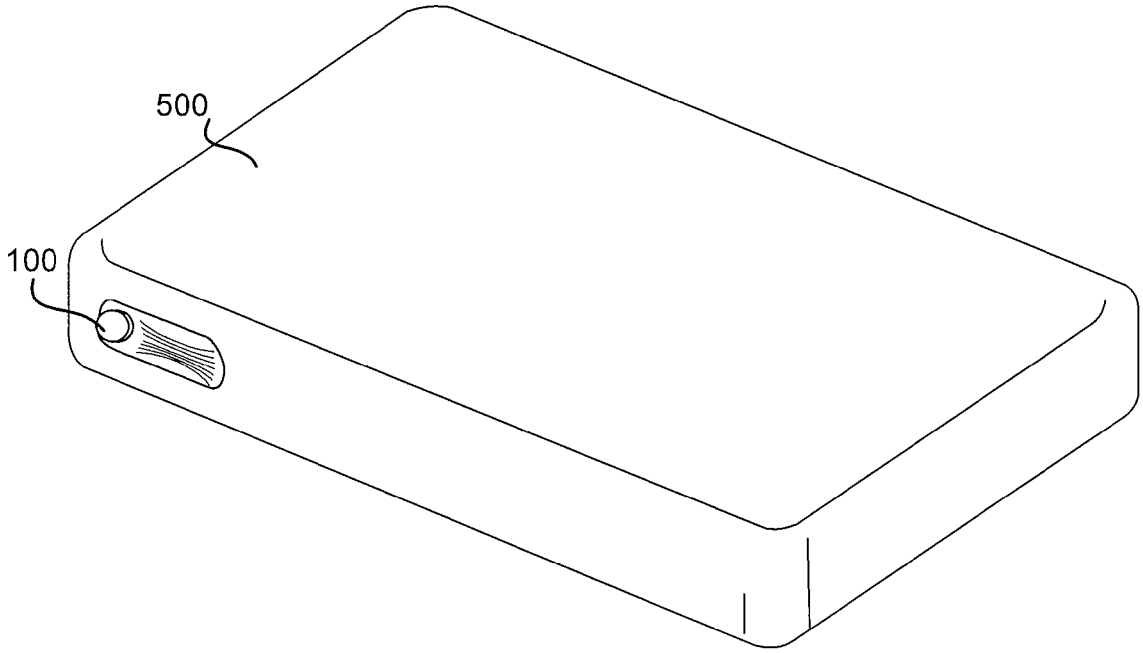
FIG. 5 illustrates the pump of FIG. 1 integrated into an inflatable device.

The blower chamber 110 of the pump 100 is configured to be inserted into the inflatable device 500 such that the blower chamber 110 is substantially disposed inside the inflatable device 500, as illustrated in FIG. 5.

Figure 3:
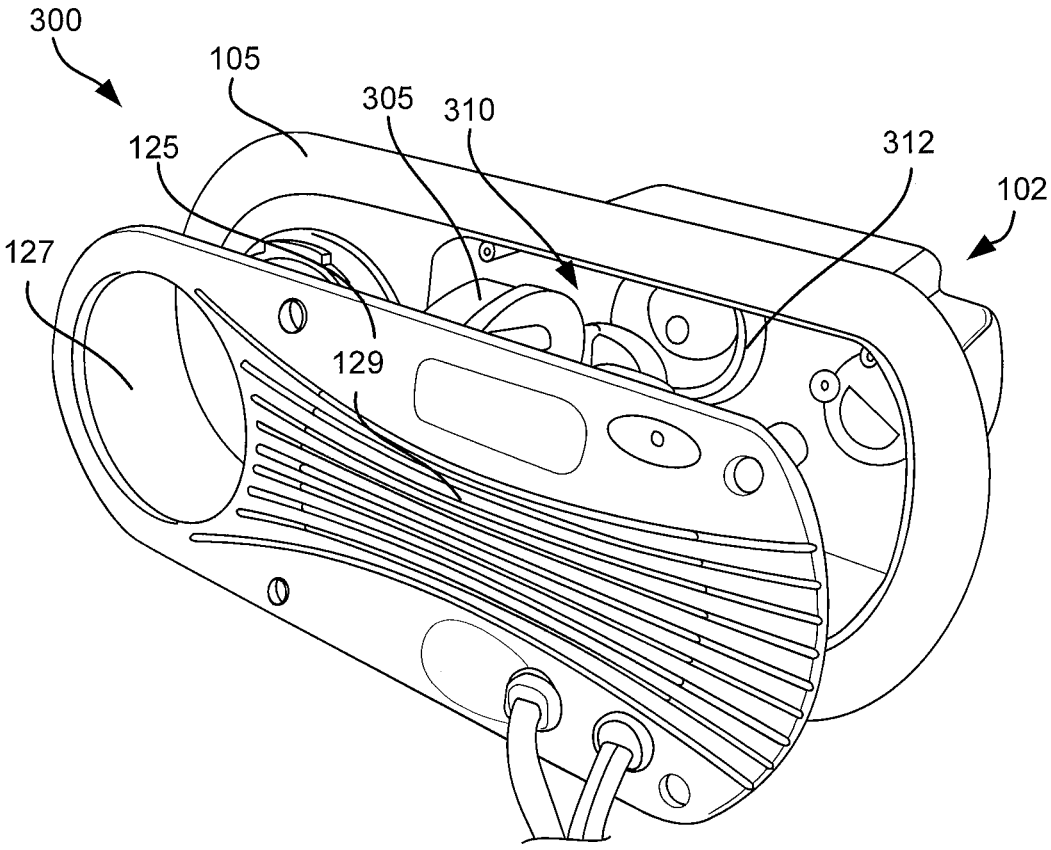
FIG. 3 illustrates the pump of FIG. 1 in a partially disassembled state.
Figure 4A:
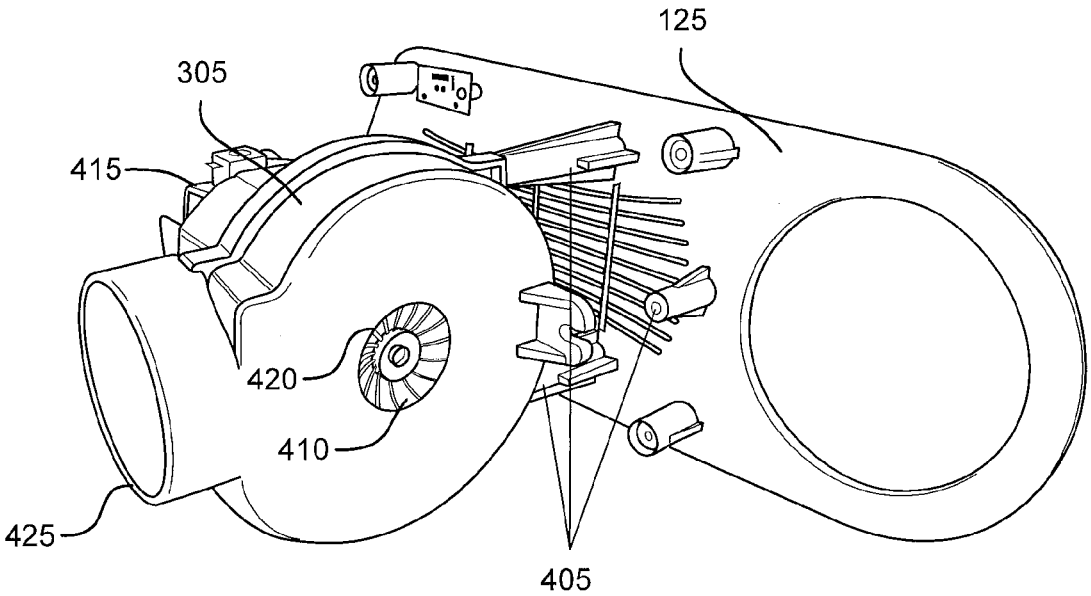
FIG. 4A illustrates a pump cover and blower of the pump of FIG. 1.

Referring to FIG. 3, the blower chamber 110 defines a cavity 310 configured to house a blower housing 305. As shown in FIG. 4A, the blower housing 305 may comprise an impeller 410, an AC or DC electric motor 415, an air inlet 420, and an air outlet 425. The electric motor 415 may be coupled to the impeller 410 via a shaft (not shown). The blower housing 305 is configured to communicate air from vents 129 defined by the cover 125 to an exhaust port 115 (FIG. 1) of the blower chamber 110 to pressurize the inflatable device 500 with enough pressure to enable the support of an object, such as a person. Air is drawn into the blower housing 305 via the air inlet 420 and exits the blower housing 305 via the air outlet 425. The air outlet 425 is configured to form a substantially air tight seal with the exhaust port 115, which may include a receiving portion 312 (FIG. 3) that is configured to be complementary to the air outlet 425.

Referring back to FIG. 1, the exhaust port 115 is configured to communicate air generated by the blower housing 305 into an internal space defined by the inflatable device 500. In some implementations, the exhaust port 115 is configured as a valve unit 116 to provide unidirectional air flow into the inflatable device 500. For example, valve unit 116 may include a valve membrane 103 that deflects to allow air to move into the inflatable device 500 and seals against a surface to prevent air from escaping from the inflatable device 500. A grill may be disposed around the valve in the valve unit 116 to prevent mechanical interference with the valve's operation. The valve may comprise a flexible material, such as rubber, silicone, or a different material capable of performing the function of the valve. The valve unit 116 can be configured to be removably attached to the blower chamber 110. As illustrated in the embodiment shown in FIG. 1B, in some implementations, the valve unit 116 is inserted into the blower cavity 310, pushed into an opening defined by the blower chamber 110, and twisted to secure the valve unit 116 to the blower chamber 110. The valve unit 116 may be removed by reversing these steps.

In some implementations, a pressure regulator (not shown) may be disposed within the blower chamber 110. The pressure regulator is configured to interrupt power to the motor 415 of the blower housing 305 when a desired air pressure is achieved inside of the inflatable device 500. The pressure regulator may be removably attached to the blower chamber 110 to enable removal of the pressure regulator.

The deflation port 140 of the housing 102 may be positioned adjacent to the blower chamber 110. The deflation port 140 enables the deflation of the inflatable device 500. In some implementations, a detachable deflation port cap 120 may be secured to the deflation port 140 to prevent air from escaping from the inflatable device 500.

At least one advantage to providing a housing with a unified blower chamber 110 and deflation port 140 is that it minimizes the number of items glued or welded to the inflatable device 500, thereby decreasing the costs associated with manufacturing the inflatable device 500. Another advantage of a housing with a unified blower chamber 110 and deflation port 140 is that the surface area for the associated attachment portion 105 is less than the surface area for respective attachment portions of a comparably sized non-unified blower chamber and deflation port. The decreased surface area lowers the likelihood of a leak developing in the inflatable device 500 in the vicinity of the pump 100.

Figure 2A:
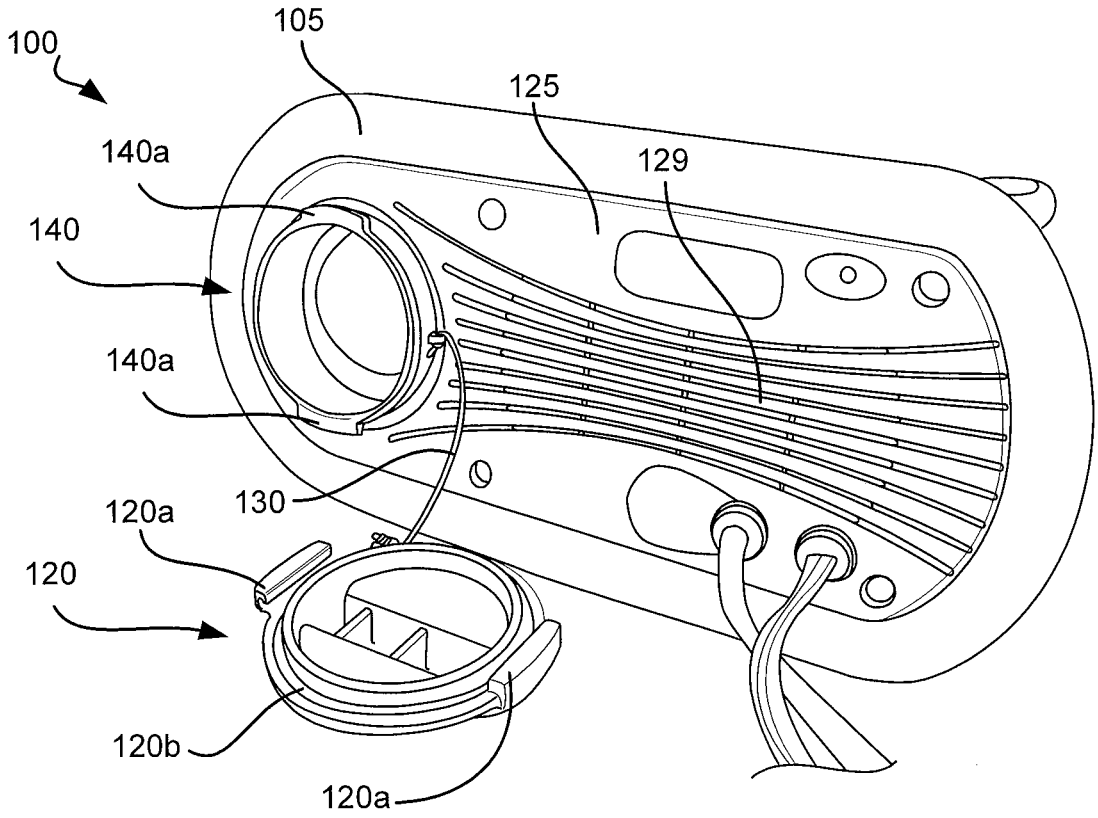
FIG. 2A illustrates a deflation port and deflation port cover of the pump of FIG. 1.
Figure 2B:
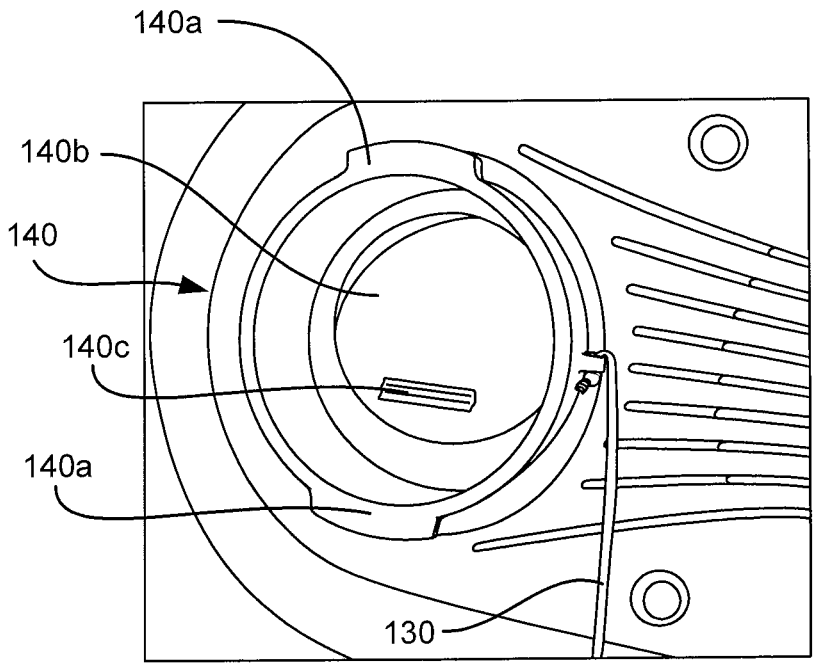
FIG. 2B illustrates details of the deflation port.

Referring to FIGS. 2A and 2B, the deflation port cap may include locking members 120*a* that are configured to engage complementary locking members 140*a* on the deflation port 140. In some implementations, the deflation port cap 120 may include a seal 120*b*, such as a rubber o-ring, to improve the air-tightness between the deflation port 140 and the deflation port cap 120. In yet other implementations, the deflation port cap 120 is tethered to the deflation port 140 to prevent misplacement of the deflation port cap 120. The deflation port cap 120 and/or the deflation port 140 may each define an aperture (not shown) for securing the tether 130.

In some implementations, the deflation port 140 includes a valve 140*b*, as shown in FIG. 2B. The valve 140*b* is configured to substantially prevent air in the inflatable device 500 from escaping through the deflation port 140 when the deflation cap 120 is removed. The valve 140*b* may comprise a flexible material, such as rubber, silicone, or a different material and is configured to form a substantially airtight seal with an inner surface of the deflation port 140 when the air pressure inside the inflatable device is greater than the surrounding air pressure. The valve 140*b* is opened by pushing the valve 140*b* in an inward direction. In some implementations, the valve 140*b* is configured to be selectively locked in an open position by pushing the valve 140*b* over retention members 142 of the deflation port 140, as illustrated in FIG. 1B. The valve 140*b* may include a member 140*c* that enables returning the valve to a closed position.

Referring to FIG. 3, the cover 125 is configured to be removably attached to the housing 102 via fasteners, such as screws, or may be removably attached in a different manner. For example, the cover 125 and/or housing 102 may include locking members that enable snapping the cover 125 into place. The cover 125 is configured to substantially cover the cavity 310 defined by the blower chamber 110. The cover 125 may define one or more vent openings 129 through which air is communicated into the blower chamber 110, and an opening 127 through which the deflation port 140 extends.

Figure 4B:
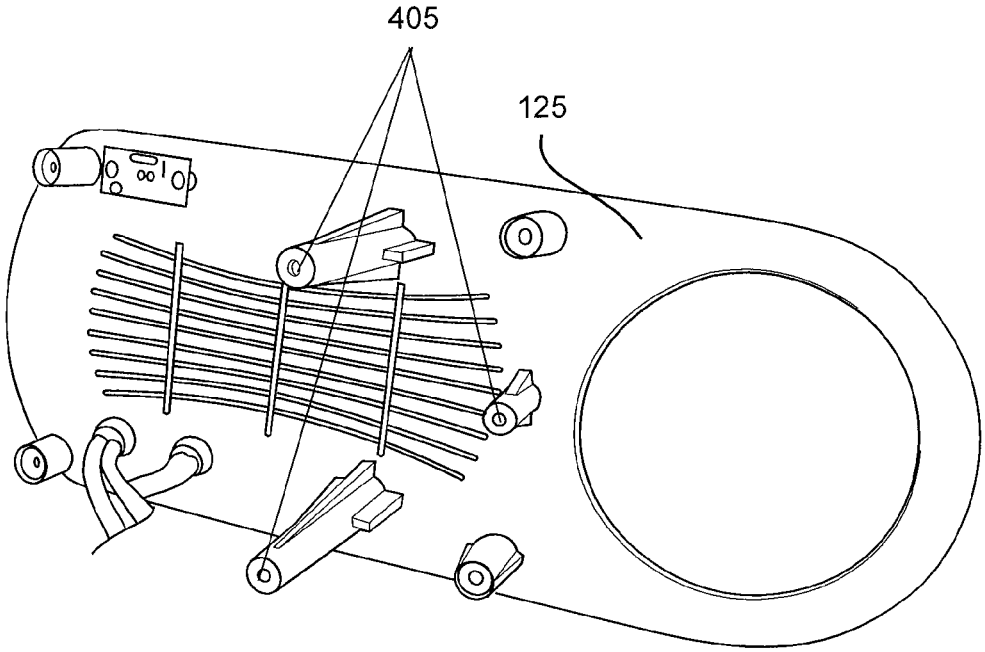
FIG. 4B illustrates the pump cover.

As illustrated in FIGS. 4A and 4B, the cover 125 may include one or more bosses 405 that enable fastening the blower housing 305 to the cover 125. For example, the blower housing 305 may be fastened to the cover 125 via screws that enable removal of the blower housing 305 for servicing. Releasable connectors may be utilized to connect the motor to other circuits so that the blower housing 305 may be easily removed. Once fastened, the cover 125 with the fastened blower housing 305 may be fastened to the housing 102.

At least one advantage to providing a removably attached cover is that it enables placement or replacement of the blower housing 305 and other components that are disposed within the blower chamber 110 without the destruction of the inflatable device 500. For example, during manufacturing, the housing 102 may be inserted and fastened to the inflatable device 500 in a first manufacturing operation. Then components of the pump 100 may be inserted into the blower chamber 110. To service the inflatable device 500, the cover may be removed to expose the blower housing 110, the valve unit 116, pressure regulator, and other components disposed within the blower chamber 110. The respective components may then be serviced.

Another advantage to providing a removably attached cover 125 is that the cover 125 may be customized independent of the other components of the pump. For example, pump housings may be attached to inflatable devices in a first manufacturing operation. During later operations, the inflatable devices with the attached housings may be differentiated via customized cover plates. For example, an OEM manufacture may select a cover design based on a customer.

While the method and system has been described with reference to certain embodiments, it will be understood by those skilled in the art that various changes may be made and equivalents may be substituted without departing from the scope. In addition, many modifications may be made to adapt a particular situation or material to the teachings without departing from its scope. Therefore, it is intended that the present method and system not be limited to the particular embodiment disclosed, but that the method and system include all embodiments falling within the scope of the appended claims.

We claim:

1. A method for manufacturing a pump for an inflatable device comprising:

providing a housing that comprises:

(i) a blower chamber configured to be inserted into said inflatable device, said blower chamber including an exhaust port configured to communicate air out of said pump;

(ii) a deflation port disposed adjacent to said blower chamber; and (iii) an attachment portion configured to make a substantially airtight seal with a surface of said inflatable device; and attaching a removably attachable cover to said housing, wherein said removably attachable cover is configured to substantially cover said blower chamber, wherein said cover defines an opening through which said deflation port extends, and wherein said cover defines at least one vent through which air is communicated into said pump.

2. The method according to claim 1, further comprising inserting a motor into said blower chamber, wherein said motor is configured to communicate air from said at least one vent to said exhaust port.

3. The method according to claim 1 further comprising providing a deflation port cap configured to cover said deflation port.

4. The method according to claim 3, further comprising providing locking members on said deflation port cap and complementary locking members on said deflation port.

5. The method according to claim 3, wherein said deflation port comprises a valve configured to substantially prevent air in said inflatable device from escaping through said deflation port when said deflation cap is removed.

6. The method according to claim 5, wherein said valve is configured to be selectively locked in an open position to enable air from said inflatable device to escape through said deflation port.

7. The method according to claim 1, further comprising inserting a pressure regulator in said blower chamber.

8. A pump for an inflatable device comprising:

(a) a housing that comprises:

(i) a blower chamber configured to be inserted into said inflatable device, said blower chamber including an exhaust port configured to communicate air out of said pump;

(ii) a deflation port disposed adjacent to said blower chamber; and (iii) an attachment portion configured to make a substantially airtight seal with a surface of said inflatable device; and (b) a cover removably attached to said housing and configured to substantially cover said blower chamber, wherein said cover defines an opening through which said deflation port extends, and wherein said cover defines at least one vent that is spaced apart from said opening through which air is communicated into said pump.

9. The pump according to claim 8, further comprising a blower housing configured to be removably attached to said cover, wherein said blower housing is disposed in said blower chamber and is configured to communicate air from said at least one vent to said exhaust port.

10. The pump according to claim 9, wherein said blower housing comprises a motor.

11. The pump according to claim 10, wherein said blower housing comprises an impeller.

12. The pump according to claim 10, further comprising fastening means on said cover for fastening said motor to said cover.

13. The pump according to claim 9, wherein said blower housing includes an outlet port configured to engage said exhaust port to form a substantially air tight seal between said blower housing and said exhaust port.

14. The pump according to claim 8 further comprising a deflation port cap configured to cover said deflation port.

15. The pump according to claim 14, further comprising locking members on said deflation port cap and complementary locking members on said deflation port.

16. The pump according to claim 8, further comprising a pressure regulator disposed in said blower chamber.

17. The pump according to claim 8, wherein said exhaust port comprises a valve configured to substantially prevent air in said inflatable device from escaping through said exhaust port.

18. The pump according to claim 8, wherein said exhaust port comprises a valve unit removably attached to said blower chamber.

19. A pump for an inflatable device comprising:

(a) a housing that comprises:

(i) a blower chamber configured to be inserted into said inflatable device, said blower chamber including an exhaust port configured to communicate air out of said pump;

(ii) a deflation port disposed adjacent to said blower chamber; and (iii) an attachment portion configured to make a substantially airtight seal with a surface of said inflatable device;

(b) a cover removably attached to said housing and configured to substantially cover said blower chamber, wherein said cover defines an opening through which said deflation port extends, and wherein said cover defines at least one vent that is spaced apart from said opening through which air is communicated into said pump; and (c) a deflation port cap configured to cover said deflation port, wherein said deflation port comprises a valve configured to substantially prevent air in said inflatable device from escaping through said deflation port when said deflation cap is removed.

20. The pump according to claim 19, wherein said valve is configured to be selectively locked in an open position to enable air from said inflatable device to escape through said deflation port.

* * * * *